US010083677B2

(12) United States Patent
Hamberger

(10) Patent No.: US 10,083,677 B2
(45) Date of Patent: Sep. 25, 2018

(54) SOUND POST HAVING A VARIABLE LENGTH

(71) Applicant: Wolfgang Hamberger, München (DE)

(72) Inventor: Wolfgang Hamberger, München (DE)

(73) Assignee: Wolfgang Hamberger, Munich (DE)

( * ) Notice: Subject to any disclaimer, the term of this patent is extended or adjusted under 35 U.S.C. 154(b) by 44 days.

(21) Appl. No.: 15/424,468

(22) Filed: Feb. 3, 2017

(65) Prior Publication Data

US 2017/0249927 A1 Aug. 31, 2017

(30) Foreign Application Priority Data

Feb. 29, 2016 (DE) ..... 20 2016 101 066 U

(51) Int. Cl.
*G10D 13/02* (2006.01)
*G10D 3/02* (2006.01)

(52) U.S. Cl.
CPC ..... *G10D 3/02* (2013.01)

(58) Field of Classification Search
CPC ..... G10D 3/02; G10D 1/085
See application file for complete search history.

(56) References Cited

U.S. PATENT DOCUMENTS 2,145,237 A 1/1939 Eberhart
5,208,408 A 5/1993 Cave

FOREIGN PATENT DOCUMENTS

DE 102014009336 6/2014
WO WO2015198237 * 12/2015 ..... G10D 1/02
84/294

* cited by examiner

*Primary Examiner* — Kimberly Lockett
(74) *Attorney, Agent, or Firm* — Kagan Binder, PLLC

(57) ABSTRACT

A sound post, particularly for string instrument, having a variable length is described. The sound post consists of a first tubular component having a first end and a second end and a second tubular component having a first end and a second end, wherein the second tubular component is at least partially arranged in the first tubular component in a movable manner, and wherein a first pivotable end piece is arranged at the first end of the first tubular component. The sound post also comprises a counter-element and a tension fastener element which is rotatably arranged and suitable to be countered against the counter-element by rotation. A pivotable end piece is also arranged at the second end of the second tubular component. A sound post tool set for mounting the sound post in an instrument and a method for mounting the sound post in an instrument are also disclosed.

23 Claims, 3 Drawing Sheets

SOUND POST HAVING A VARIABLE LENGTH

This application claims benefit from German Application No. 202016101066.7, which was filed on Feb. 29, 2016, the entirety of said patent application is incorporated herein by reference.

BACKGROUND OF THE INVENTION

Field of the Invention

The present invention relates to a sound post having a variable length, a sound post tool set and a method for mounting a sound post having a variable length, particularly in a string instrument.

Description of the Prior Art

It is known that in some musical instruments, particularly in string instruments, a sound post is mounted between the top and back plates, primarily in an area below a foot of the bridge. Traditionally, this is a wooden cylinder fitted in length and shape of its both ends to the inner side of the top and back plates of the instrument, thus improving the stability and sound properties of the instrument. Since in the intact state of a string instrument its inside space is merely accessible through the so-called f-holes, it is very difficult and expensive to manufacture a wooden cylinder of the exactly right length and with the correctly shaped ends as well as to put it in and set it to the right position inside the instrument. Thus, mounting a sound post for a string instrument is associated with multiple attempts and adjustments so that an adjustment needed due to, for example, changing weather conditions, ambient temperature and/or air humidity, caused e.g. by the transition from summer to winter, can only be achieved under great efforts. However, if the sound post has the wrong length or if the arching changes due to temperature or air humidity fluctuations, this can have negative impact on the sound and the stability of the instrument.

Thus, the prior art discloses sound posts having a variable length. For example, DE 10 2014 009 336 discloses a generally two-part sound post both parts of which can be screwed together which makes the sound post adjustable in length.

U.S. Pat. No. 5,208,408 also shows, for example in FIG. 8, a sound post having a variable length consisting of generally two components that can be screwed together in order to be able to variably adjust the length of the sound post.

While the length of the sound post, according to both previously mentioned references, can be adjusted by screwing together the two components, U.S. Pat. No. 2,145,237 offers a generally two-part sound post, wherein the length of the sound post can be adapted to the variations of the distance between the top and back plates caused, for example, by the temperature and air humidity fluctuations, by means of a spring-loaded support of both components.

In both variants according to U.S. Pat. No. 5,208,408 and DE 10 2014 009 336 that suggest screwing the components together, the problem is that, to be able to insert the sound post into the string instrument, the length of the sound post must be, at least roughly, pre-adjusted as shorter than the distance between the top and back plates. As sometimes the sound post is too short due to this pre-adjustment, it can easily fall down when inserting it into the instrument which leads to difficulties because of the poor accessibility through the both f-holes alone. Alternatively, the length of the sound post is adjusted to be greater than the distance between the top and back plates to wedge it between the top and back plates. Thus, the feeling of the tension which is essential for the sound quality is lost. Contrary to that, the disadvantage of the sound post having a spring-loaded support according to U.S. Pat. No. 2,145,237 is that the length of the sound post in the instrument can not be fixed and thus a consistent sound property and stability can not be ensured.

SUMMARY OF THE INVENTION

In view of the prior arts, an object of the present invention is to provide a sound post having a variable length, particularly for a string instrument, which is easy to insert and which improves the sound properties of the string instrument.

This object could be achieved by means of a sound post having the features of any one of claims 1 to 4, for example.

Moreover, the object of the present invention is to facilitate the mounting of a sound post in an instrument. This object could be achieved by means of a sound post tool set for installing a sound post between the top and back plates of a string instrument having the features of claim 18 or 19, for example.

A further object of the invention is to provide a method for easy mounting of a sound post having a variable length. This object is achieved using the methods for mounting a sound post having the features of claim 20 or 21, for example.

Further refinements and preferred embodiments of a sound post according to the invention, the sound post tool set and the method are disclosed in the sub-claims, for example.

One embodiment of a sound post having a variable length, particularly for string instruments, consists of a first tubular component with a first end and a second end and a second tubular component with a first end and a second end, wherein the second tubular component is at least partially moveably arranged in the first tubular component and wherein a first pivotable end piece is arranged at the first end of the first tubular component and the second end of the first tubular component serves as a counter-element, and wherein the first end of the second tubular component has an external thread at which a tension fastener element is rotatably arranged in order to be countered against the counter-element by means of rotation, and a second pivotable end piece is arranged at the second end of the second tubular component and wherein the first pivotable end piece and the second pivotable end piece are made at least partially of a magnetizable material or as magnets.

A further embodiment of a sound post having a variable length, particularly for string instruments, consists of a first tubular component with a first end and a second end and a second tubular component with a first end and a second end, wherein the second tubular component is at least partially moveably arranged in the first tubular component and wherein a first pivotable end piece is arranged at the first end of the first tubular component and the second end of the first tubular component has an external thread at which a tension fastener element is rotatably arranged, and wherein a counter-element with a second pivotable end piece is arranged at the second end of the second tubular component, and wherein the first pivotable end piece and the second pivotable end piece are made at least partially of a magnetizable material or as magnets.

A further embodiment of a sound post having a variable length, particularly for string instruments, consists of a first tubular component with a first end and a second end, a second tubular component with a first end and a second end, wherein the second tubular component is at least partially moveably arranged in the first tubular component, and an elastic member coupled to the first end of the second tubular component is arranged within the first tubular component, wherein a first pivotable end piece is arranged at the first end of the first tubular component, and the second end of the first tubular component serves as a counter-element, and wherein the first end of the second tubular component has an external thread at which a tension fastener element is rotatably arranged in order to be countered against the counter-element by means of rotation, and a second pivotable end piece is arranged at the second end of the second tubular component.

A further embodiment of a sound post having a variable length, particularly for string instruments, consists of a first tubular component with a first end and a second end, a second tubular component with a first end and a second end, wherein the second tubular component is at least partially moveably arranged in the first tubular component, and an elastic member coupled to the first end of the second tubular component is arranged within the first tubular component, wherein a first pivotable end piece is arranged at the first end of the first tubular component, and the second end of the first tubular component has an external thread at which a tension fastener element is rotatably arranged, and wherein a counter-element with a second pivotable end piece is arranged at the second end of the second tubular component.

The sound post according to the invention can be used in any type of instruments in which vibrations are transferred from a top plate to a back plate. Examples of such instruments are string instruments such as violin, viola, violoncello, contrabass, but also guitars or other types of plucked instruments, for example zither or even hammered dulcimer. Due to the fact that a sound post according to the present invention has a variable length and that both components in the sound post can be pushed together for mounting, and due to the fact that the sound post is adjacent to the top and the back plate inside the instrument either by means of a resilient connection of both of its members or even by means of magnets which are arranged outside at the instrument, but still can easily be displaced, the mounting of the sound post is substantially easier compared to the prior art. Due to the fact that the sound post according to the present invention can be fixed in its installed state by means of the tension fastener element by rotating against the counter-element in its length, a consistent sound quality and stability can be ensured. By countering the tension fastener element against the counter-element, the final height of the sound post in the instrument can be securely and exactly adjusted in order to significantly improve both the sound quality and the stability. Since a bigger sound post is used, for example, in a contrabass than in a violin, the dimensions of the sound post according to the invention must be correspondingly adapted to its use in the corresponding instrument.

According to a further embodiment, the sound post according to the invention comprises a resting member in order to avoid twisting the first or the second tubular component when screwing the tension fastener element against the counter-element.

According to a further embodiment, even in the embodiments of the sound post according to the invention in which the first pivotable end piece and the second pivotable end piece are made at least partially of a magnetizable material or as magnets, an elastic member can be arranged within the first tubular component coupled to the first end of the second tubular component. Thus, even these embodiments, for example, can prevent the sound post from falling down when mounting it.

According to a further embodiment, one or more of the first and the second tubular components and pivotable end pieces in a sound post according to the invention can be made of wood.

According to a further advantageous embodiment, one or more of the first and the second tubular components and pivotable end pieces in a sound post according to the invention can be made of plastic.

According to a further embodiment, one or more of the first and the second tubular components and pivotable end pieces in a sound post according to the invention can be made of fiber-reinforced plastic, preferably of carbon fiber-reinforced plastic.

According to a further embodiment, the first pivotable end piece and the second pivotable end piece in a sound post according to the invention can be at least partially coated with a magnetic material. Thus, even in case of a low-density non-magnetic material, e.g. plastic or wood, an interaction with a magnet can be achieved, for instance, to facilitate the fine positioning of the sound post.

According to a further embodiment, the second tubular component between the second end piece and its first end in a sound post according to the invention comprises a through-bore arranged transversely to the longitudinal axis of the tubular component. This bore can, for example, serve to facilitate the insertion of the sound post by means of a thread drawn through the said bore which is also drawn through both f-holes of the string instrument. The through-bore can also be used—by means of a special insertion tool, e.g. a wire having a corresponding thickness—to avoid a rotation of the second tubular component when twisting the tension fastener element against the counter-element.

According to a further embodiment, both the first and the second end pieces can be made from magnetic materials. Advantageously, for instance, the sound post fitted inside the string instrument can be shifted and/or set upright with particular ease by means of a magnet moved externally along the top or the back plate of the instrument. On the other side, the exact position of the sound post inside the instrument can also be detected from the outside, for example, with the help of flat magnetic detectors. An example of such a surface detector could be a foil, as for example used in a so-called "magic board" which utilizes magnetic iron filings arranged in special honeycombs in order to show the position of a magnet.

According to a further embodiment of a sound post according to the invention, the elastic member can be a spring or a pneumatic spring so that the first and the second tubular component act as a shock absorber, or it can be made of rubber, natural rubber and/or a foamed material. The foamed material can be foam, for example. The elastic member could also consist of two repelling magnets or a combination of the previously mentioned implementation options.

According to a further embodiment of a sound post according to the invention, at least one of the tension fastener element and the resting member can be made of metal or plastic.

According to a further embodiment of a sound post according to the invention, at least one of the tension fastener element and the resting member can have a polygonal, preferably octagonal, cross-section, for example, in order to facilitate the turning process with a corresponding tool.

According to a further embodiment of a sound post according to the invention, the first tubular component and the second tubular component are substantially cylindrical. It means that the cross-section of the first and the second tubular component is substantially circular. The present invention is however not limited to a circular cross-section of the first and the second tubular component. The cross-sections could also be polygonal, e.g. square, rectangular or even oval.

According to a further embodiment of a sound post according to the invention, each of the end pieces comprises a partially spherical section and a flat end surface so that the first tubular component at its first end and the second tubular component at its second end with a partially spherical recess, respectively, can receive the respective partially spherical section of the corresponding end piece. By means of this implementation of the end pieces and the corresponding recesses of the tubular components, it is ensured that the end pieces can be perfectly fitted to the not necessarily plane parallel inner surfaces of the top and the back plate of the instrument. Advantageously, the flat end surface can be slightly roughened in order to prevent slipping on the wood on the inner surface of the top and the back plate. For example, chalk can provide even more friction. The partially spherical section of the end pieces advantageously fits so easily in the partially spherical recesses of the tubular components that the spring pressure is sufficient for them to adapt to the arching. Roughened surfaces on the partially spherical sections and the partially spherical recesses and/or rubber dust in the partially spherical recesses prevent the rotation of rest of the construction when the counter-element is rotated.

Moreover, the invention comprises a sound post tool set for mounting a sound post having a variable length between the top and the back plate of a string instrument with a sound post and at least one adjusting tool comprising a fork-like portion, a shaft and a holding portion, wherein the shaft is arc-shaped and its length corresponds at least to a length of a distance between a predetermined f-hole of the string instrument and a position at a string instrument back plate predetermined for the sound post. In case of a tension fastener element having a polygonal cross-section, the fork portion of the setting tool has a corresponding cross-section in order to perfectly embrace the tension fastener element to be able to rotate the same. Because of restricted space when inserting the tool through the f-hole of the string instrument, it is advantageous to provide the polygonal cross-section with as many corners as possible so as to be able to implement small rotation angles as well.

According to a further embodiment, the sound post tool set moreover comprises two magnets suitable to be respectively moved externally along the back and the top plate of the string instrument, respectively, in order to set upright and/or to position the sound post.

Furthermore, the invention comprises a method for mounting a sound post by means of a sound post tool set with the following steps:

providing a sound post having a predetermined length selected so that the length of the sound post in a relaxed state is greater than the distance between the back and the top plate of the string instrument and in a compressed state, when a force is exercised against both end pieces (5, 6), is less than the distance between the back and the top plate of the string instrument, and inserting the sound post in a relaxed state through an f-hole of the string instrument, and fitting the sound post in a position predetermined within the string instrument by wedging the sound post at an angle between the back and the top plate and compressing the elastic member (4) and positioning the sound post vertically between the back and the top plate of the string instrument, and inserting an adjusting tool in an f-hole and fixing the length of the sound post by rotating the tension fastener element with the adjusting tool against the counter-element.

Furthermore, the invention comprises a further method for mounting a sound post by means of a sound post tool set with the following steps:

providing a sound post having a predetermined length selected so that the total length of the first tubular component and the second tubular component of the sound post in the extended state is greater than the distance between the back and the top plate of the string instrument, and inserting the sound post through an f-hole of the string instrument, and setting upright the sound post, in a retracted state, and preliminary fitting it in a position predetermined within the string instrument by applying and moving one of the magnets of the sound post tool set externally along the back and the top plate of the string instrument, and rotating the instrument in such a way that the preliminary positioned sound post, in a retracted state, gets extended between the back and the top plate of the string instrument due to gravity, and applying the second magnet of the sound post tool set externally on the back or the top plate of the string instrument opposite the first magnet and to the position of the extended sound post, and finally positioning the extended sound post by moving both magnets of the sound post tool set externally along the back and the top plate of the string instrument, and inserting an adjusting tool in an f-hole and fixing the length of the sound post by rotating the tension fastener element with the adjusting tool against the counter-element.

Specific embodiments and advantages of these embodiments will become clear and easily understandable with the aid of the detailed description with respect to the accompanying drawings. Identical or similar elements of these Figures are designated with the same reference numbers. The Figures are merely a schematic illustration of an embodiment of the invention, and the dimensions of the illustrated components can also particularly vary depending on the intended application in the different instruments. The invention is not limited to the specific illustrated embodiments, and actually the scope of the invention is determined by the subject-matter of the claims.

DETAILED DESCRIPTION OF THE EMBODIMENTS

The embodiments of the sound post according to the invention illustrated in the Figures relate to a sound post having a variable length for string instruments. As illustrated at the beginning, the sound post according to the invention can also be utilized in other instruments, for example, guitars, zithers or hammered dulcimers or similar instruments in order to advantageously influence the stability and the sound of the instrument, for example.

Figure 1:
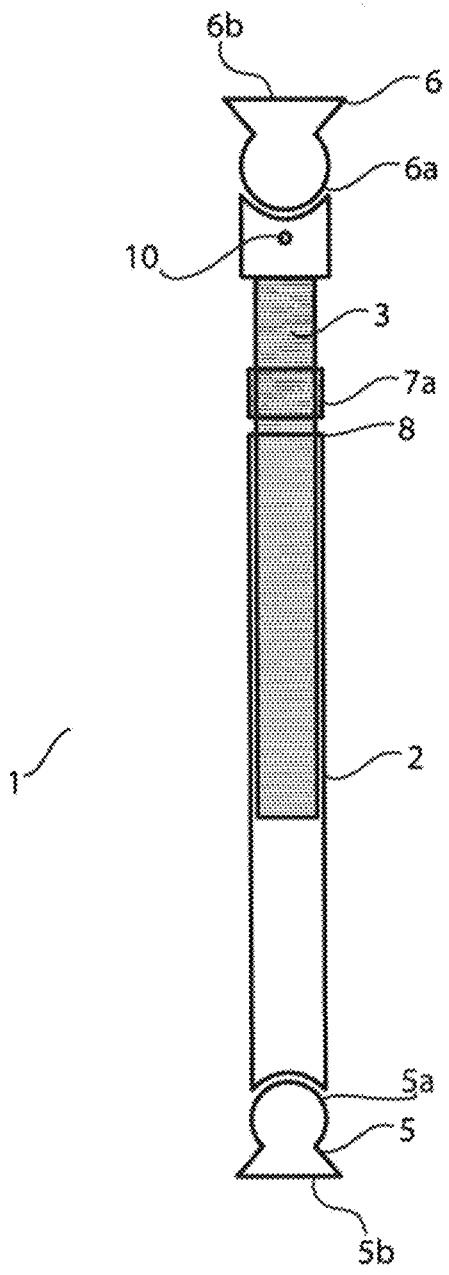
FIG. 1 shows a longitudinal cross-section of a first exemplary embodiment of a sound post according to the invention without an elastic member.
Figure 2:
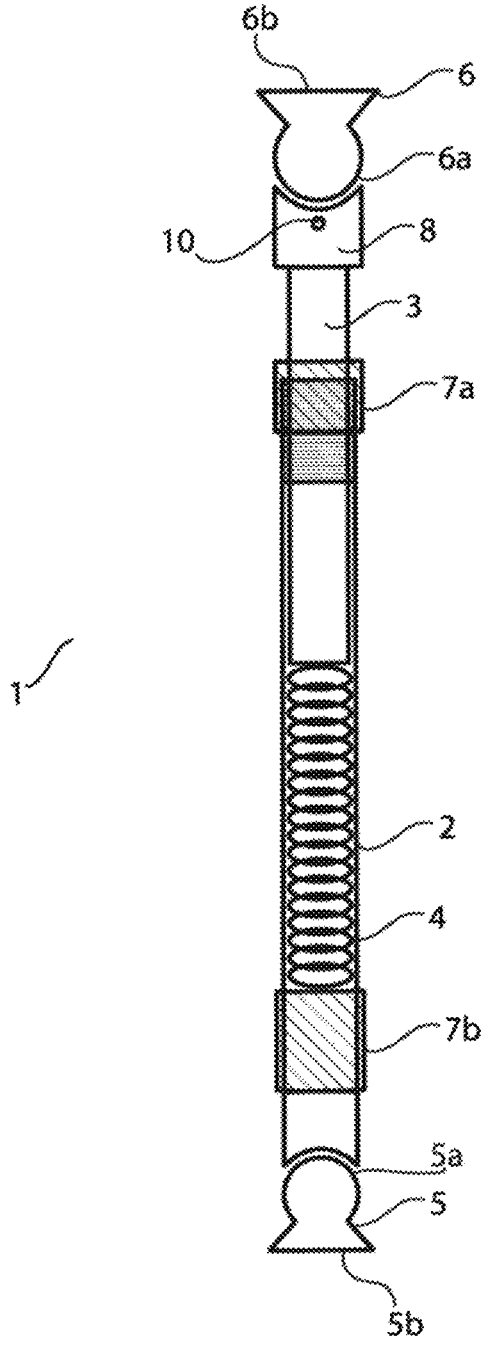
FIG. 2 shows a longitudinal cross-section of a second exemplary embodiment of a sound post according to the invention with an elastic member.

The FIGS. 1 and 2 show, respectively, an embodiment of a sound post having a variable length according to the invention, particularly as it can be used for string instruments. The sound post according to the invention consists of a first tubular component 2 having a first end and a second end and a second tubular component 3 having a first and a second end, wherein the second tubular component 3 according to an embodiment is displaceable against the force of an elastic member 4 in the first tubular component 2 in the longitudinal direction of the tubular component 2. A first pivotable end piece 5 is arranged at the first end of the first tubular component 2, and a second pivotable end piece 6 is arranged at the second end of the second tubular component. By pivoting the first and the second end pieces 5, 6, it is ensured that the end surfaces of the end pieces are perfectly fitted to the inner surfaces of the top and the back plate of the string instrument. Since the first and the second end pieces 5, 6 are formed pivotably, these end pieces can be perfectly fitted to the inner surfaces of the top and the back plate of the string instrument even if the top or the back plates are curved and their inner surfaces are thus not parallel. Due to elastic bedding of the second tubular component 3 in the first tubular component 2, the length of the sound post can be shortened by pressure on the first and the second pivotable end pieces 5, 6, thus facilitating the mounting of the sound post inside the string instrument. When pressure on the first and the second pivotable end pieces 5, 6 is released inside the string instrument, the sound post gets extended, its length increases, and the first and the second pivotable end pieces 5, 6 are pushed by the force of the elastic member 4 from below against the back and the top plate of the string instrument so that the sound post can not fall down when being mounted even at a temporary position inside the string instrument, for example. If the sound post according to the invention is arranged in the proper position within the string instrument, the sound post according to the invention comprises a tension fastener element 7*a* which can be countered against the counter-element 8 so that the sound post in the secured state has a fixed length, and the elastic power of the elastic member 4 is disabled in this state. In the embodiment in FIG. 1, the tension fastener element 7*a* is rotatably connected to the second tubular component 3 by means of an outer thread at the first end of the second tubular component 3 for the purpose of fixing the length of the sound post and can be countered against the second end of the first tubular component 2 by means of rotation. As evident from FIG. 1, the edge of the second end of the first tubular component 2 acts in this case as a counter-element 8. With the aid of the outer thread at the first end of the second tubular component 3 and the tension fastener element 7*a*, the length of the sound post according to the invention can be fixed. By means of this adjustment and fixing the length of the sound post, both the sound of the instrument and the stability can be persistently improved. The outer thread and the correspondingly adapted thread of the tension fastener element 7*a* can hereby be a standardized metric thread, for example M2 to M10, or a special fine thread in order to be able to precisely adjust the length of the sound post according to the invention.

In the embodiment of FIG. 2, the length of the sound post according to the invention is fixed with the help of an outer thread arranged at the second end of the first tubular component 2 and a corresponding tension fastener element 7*a* which is rotatably arranged at this outer thread. As evident from FIG. 2, the tension fastener element 7*a* according to the embodiment of FIG. 1 is countered against the counter-element 8 arranged at the second end of the second tubular component 3 so as to fix the length of the sound post.

In the embodiment shown in FIG. 1, the sound post 1 having a variable length does not comprise the elastic member 4. In this embodiment, the first pivotable end piece 5 and the second pivotable end piece 6 are made at least partially of a magnetizable material or as magnets. Thereby, for inserting the sound post 1 in the instrument, the second tubular component 3 can be pushed into the first tubular component 2 (a retracted state) and after having been inserted into the instrument it can be set upright by means of one and/or two magnets from the outside of the instrument. For setting upright the sound post 1, in a retracted state, and preliminary fitting it in a position predetermined within the string instrument, a magnet of a sound post tool set can be applied externally on the back or the top plate of the string instrument and correspondingly moved. The temporary positioned sound post, in a retracted state, gets extended by rotating the instrument so that the first tubular component 2 and the second tubular component 3 are pulled apart due to gravity and get fixed between the back and the top plate of the string instrument.

According to a further embodiment, even in the embodiment with the first pivotable end piece 5 and the second pivotable end piece 6, at least partially formed of a magnetizable material or as magnet, an elastic member 4 can be additionally arranged in the first tubular component 2.

The elastic member 4 can be, for example, a spring element such as a coil spring, a pneumatic spring or a kind of damper so that the first and the second tubular component act as a shock absorber, or it can be made of rubber, natural rubber, or the elastic member can be made of a foamed material, for instance foam or the like. A foamed material has the advantage compared to a coil spring that, for example, it does not transfer vibrations when playing the instrument and thus is absolutely noise-damped. Two repellent magnets can also be used as elastic member, for example. As disclosed above and seen from FIGS. 1 and 2, the elastic member 4 is arranged in the first tubular component 2 and coupled to the first end of the second tubular component 3. Hereby, it is clear that it must not necessarily be a direct coupling and that any intermediate members can be arranged between the elastic member 4 and the first end of the second tubular component or also between the elastic member 4 and the first end of the first tubular component. Moreover, the elastic member 4 could be made of a combination of different elastic members, for example the combination of a foamed material and a coil spring. In a further embodiment, the elastic member 4 can be coupled to the first end of the second tubular component 3 and to the first end of the first tubular component 2, i.e. at both ends. This prevents the components from falling apart when the sound post 1 is inserted before it gets wedged between the back and the top plate.

According to the present invention, the tension fastener element 7*a* is countered against the counter-element 8 for fixing the length of the sound post along an outer thread. For rotation of the tension fastener element 7*a*, the tension fastener element 7*a* comprises a correspondingly shaped outer surface in order to allow for rotation. This outer surface can, for example, be simply roughened as in a knurled screw or be slotted or have a polygonal cross-section in order to be rotated with a correspondingly shaped adjusting tool. This polygonal cross-section can, for example, be square or octagonal or even comprise more edges in order to allow for the smallest possible rotation angles, for example. Since the room for moving an adjusting tool 11 inserted through the f-hole of a string instrument is, for example, very scarce, it is advantageous to provide the tension fastener element with a big amount of edges in order to allow for small rotation angles, as well.

To avoid twisting the first tubular component or the second tubular component 3 when countering the tension fastener element against the counter-element 8, the sound post according to the invention can comprise a resting member 7*b*. As shown in FIG. 1, the sound post according to the first embodiment can comprise said resting member at the first end of the second tubular component 3, for example, as polygonal cross-section at the first end of the second tubular component 3 or even as a bore 10. In the embodiment according to FIG. 2, the resting member can be arranged at the outer side of the first tubular component 2. To arrange the resting member 7*b*, it is advantageous to determine its position so that it could be possible to reach it with an adjusting tool. That means that the resting member 7*b* shall be arranged along the tubular component in such a way that it could be easily accessible with an adjusting tool through an f-hole of the string instrument.

Wood, plastic, fiber-reinforced plastic, preferably carbon fiber reinforced plastic or, for example, metals such as aluminum, magnesium or alloys or combinations thereof can be used as materials for one or more of the first and the second tubular components and the pivotable end pieces of the sound post according to the invention. The tension fastener element 7*a* and/or the resting member 7*b* can also be made of another material than the first and the second tubular component, for example, of metal or plastic. According to one embodiment, the first pivotable end piece 5 and the second pivotable end piece 6 are made at least partially of a magnetizable material or as magnets. For this purpose, according to a further embodiment, the first pivotable end piece 5 and the second pivotable end piece 6 can be at least partially coated with a magnetic material.

To facilitate positioning of the sound post inside the string instrument or in the function of a resting member 10, the second tubular component 3 can comprise a continuous bore 10 arranged transversally to the longitudinal axis of the tubular component 3 between the second end piece 6 and its first end. To insert the sound post according to the invention, a thread can be passed through from one f-hole into the other f-hole of the string instrument, and the sound post can be attached to this thread through the continuous bore 10. Attached to this thread, the sound post 1 according to the invention can then be guided to the desired position inside the string instrument so that the continuous bore can prevent the sound post from falling down inside the instrument as well.

The first and the second pivotable end pieces 5, 6 of the sound post according to the invention can each comprise a partially spherical section 5*a*, 6*a* and a flat end surface 5*b*, 6*b*, and the corresponding ends of the first tubular component 2 and the second tubular component 3 can each comprise partially spherical recesses to receive the respective partially spherical section of the corresponding end piece 5, 6. Due to the fact that the sections of the end pieces and the recess of the corresponding sides of the first and the second tubular component are implemented in a partially spherical form, a large pivoting range can be realized to make it possible to adapt to the curvature inside an instrument to ensure a snug fit of the flat end surface 5*b*, 6*b* of the respective end piece 5, 6 to the corresponding back or top plate inside the string instrument. To prevent the end pieces 5, 6 from falling down from the corresponding ends of the first and the second tubular component 2, 3, the corresponding edge of the corresponding end of the first and the second tubular component can be formed in such a way that it partially encloses the partially spherical section 5*a*, 6*a* of the end pieces 5, 6 so that clip fixing can prevent them from falling out when assembling the sound post according to the invention.

The first and the second end pieces 5, 6 can, for example, be also formed magnetically in order to be able to be positioned from the outside by means of a magnet applied externally on the top and/or back plate, for example. The fact that the first and the second end pieces are formed magnetically has a further advantage in that the position of the set sound post can be easily displayed by flat detectors on the outer side of the string instrument.

Figure 3:
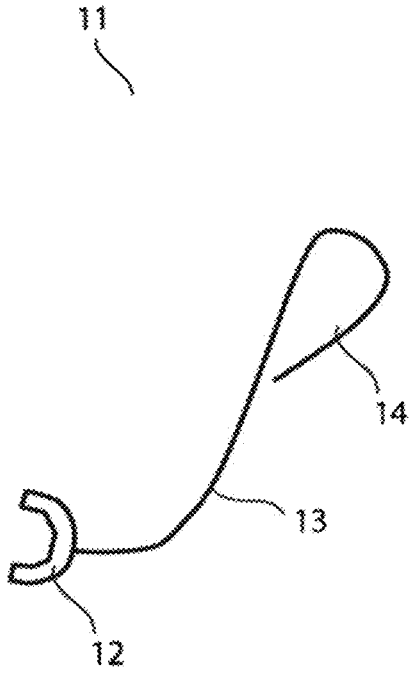
FIG. 3 shows a schematic view of an adjusting tool of the sound post tool set.

FIG. 3 shows an embodiment of an adjusting tool 11 of a sound tool set according to the invention for mounting a sound post having a variable length between the top and the back plate of a string instrument. The adjusting tool 11 comprises a fork-like portion 12, a shaft 13 and a holding portion 14. The shaft 13 can hereby be arch-shaped and have a length that corresponds at least to a length of a distance between a predetermined f-hole of the string instrument and a position at a string instrument back plate predetermined for the sound post 1. The fork-like portion 12 can be formed in such a way that it perfectly encompasses the tension fastener element 7*a* and/or the resting member 7*b* in order to be able to rotate or hold these correspondingly.

For precisely positioning the sound post and correcting the position, the "sound post setter" used in violin making can also be used.

For precisely positioning the sound post and correcting its position, the sound post tool set according to an embodiment can moreover comprise two magnets suitable to be respectively moved externally along the back and the top plate of the string instrument, respectively, in order to set upright and/or to position the sound post (1).

According to an embodiment, the mounting a sound post according to the invention by means of a sound post tool set according to the invention comprises the steps of providing a sound post having a predetermined length selected so that the length of the sound post in an relaxed state is greater than the distance between the back and the top plate of the string instrument and in a compressed state, when a force is exercised against both end pieces (5, 6), is less than the distance between the back and the top plate of the string instrument. By inserting the relaxed sound post through an f-hole of the string instrument and temporarily wedging the sound post at an angle between the back and the top plate of the string instrument and by compressing the elastic member (4) and positioning the sound post vertically between the back and the top plate, the sound post can be positioned at a position predetermined within the string instrument. If required, the sound post positioned as described above, which is wedged between the back and the top plate by spring force of the elastic member 4, can be further corrected in its position with a sound post setter or an adjusting tool 11. Here, it is advantageous, among other things, that even a temporarily mounted sound post cannot fall down thanks to the spring force. When the sound post 1 is set to the correct position, one inserts an adjusting tool 11 in an f-hole and fixes the length of the sound post 1 by rotation (countering) the tension fastener element 7*a* with the adjusting tool 11 against the counter-element 8. To avoid twisting the first or the second tubular component, a second adjusting tool 11 can for example be also inserted through the second f-hole of the string instrument, and a resting member 7*b* can be held tightly in place.

According to a further embodiment, the mounting of a sound post according to the invention by means of a sound post tool set according to the invention comprises providing a sound post 1 having a predetermined length selected so that the total length of the first tubular component 2 and the second tubular component 3 of the sound post 1 in the extended state is greater than the distance between the back and the top plate of the string instrument, and inserting the sound post 1 through an f-hole of the string instrument. The retracted sound post 1 is set upright and preliminary fitted in a position predetermined within the string instrument by applying and moving one of the magnets of the sound post tool set externally along the back and the top plate of the string instrument. By rotating the instrument, the preliminary positioned sound post, in a retracted state, gets extended between the back and the top plate of the string instrument due to gravity. The method also comprises applying the second magnet of the sound post tool set externally on the back or the top plate of the string instrument opposite the first magnet and to the position of the extended sound post, and finally positioning the extended sound post by moving both magnets of the sound post tool set externally along the back and the top plate of the string instrument. By inserting an adjusting tool 11 in an f-hole, the length of the sound post 1 can be fixed by rotating the tension fastener element 7*a* with the adjusting tool 11 against the counter-element 8. To change the position and/or the length of a fixed sound post (e.g. in case of permanently changing temperature and/or air humidity, e.g. due to dry heating air in winter), a magnet must merely be applied externally on each side of the instrument at the position of the sound post. These magnets then hold the sound post in its position in an extended state even in case of a relaxed tension fastener element 7*a*, so that the position of the extended but relaxed sound post can then be corrected from outside of the instrument by moving the magnets and/or its length can be changed by rotation the tension fastener element 7*a*.

According to a particularly advantageous embodiment, the counter-element 8 can be labeled to mark the position of twisting of the counter-element in relation to the tension fastener element 7*a*. A particularly simple form of labeling could be marking the counter-element and the tension fastener element 7*a* with spots of color to mark the "neutral", i.e. the position with the lowest tension, or the "optimal" position, for example. For this, different colors can for example be used, e.g. a white dot for the optimal setting in winter and a red one for summer. The labeling type is however not restricted to colors; for example, lines of different length can also be used for marking.

Thanks to the variable length of the sound post according to the invention and, particularly, thanks to the simple process of fixing of the length, the sound post, particularly its length, can be easily adjusted, for example, also in case of changing room temperature, e.g. between summer and winter, so that the best sound quality of the string instrument can be achieved in every season or at any humidity level. As soon as the correct position inside the instrument has been set, the sound post can remain in this position and, for example, its length can only be optimized with the aid of adjusting tools 11.

The invention is not limited to the specific illustrated embodiments, and actually the scope of the invention is determined by the subject-matter of the claims.

The invention claimed is:

1. A sound post (1) having a variable length, comprising:

a first tubular component (2) having a first end and a second end, a second tubular component (3) having a first end and a second end, wherein the second tubular component (3) is at least partially arranged in the first tubular component (2) in a movable manner, wherein a first pivotable end piece (5) is arranged at the first end of the first tubular component (2), and the second end of the first tubular component (2) serves as a counter-element (8), and wherein the first end of the second tubular component (3) comprises an outer thread at which a tension fastener element (7*a*) is rotatably arranged and which is suitable to be countered against the counter-element (8) by rotation, and a second pivotable end piece (6) is arranged at the second end of the second tubular component (3), and wherein the first pivotable end piece (5) and the second pivotable end piece (6) are made at least partially of a magnetizable material or as magnets.

2. A sound post (1) having a variable length, comprising:

a first tubular component (2) having a first end and a second end, a second tubular component (3) having a first end and a second end, wherein the second tubular component (3) is at least partially arranged in the first tubular component (2) in a movable manner, wherein a first pivotable end piece (5) is arranged at the first end of the first tubular component (2), and the second end of the first tubular component (2) comprises an outer thread at which a tension fastener element (7*a*) is rotatably arranged, and wherein a counter-element (8) with a second pivotable end piece (6) is arranged at the second end of the second tubular component (3), and wherein the first pivotable end piece (5) and the second pivotable end piece (6) are made at least partially of a magnetizable material or as magnets.

3. A sound post (1) having a variable length, comprising:

a first tubular component (2) having a first end and a second end, a second tubular component (3) having a first end and a second end, wherein the second tubular component (3) is at least partially arranged in the first tubular component (2) in a movable manner, and an elastic member (4) coupled to the first end of the second tubular component (3) is arranged within the first tubular component (2), and wherein a first pivotable end piece (5) is arranged at the first end of the first tubular component (2), and the second end of the first tubular component (2) serves as a counter-element (8), and wherein the first end of the second tubular component (3) comprises an outer thread at which a tension fastener element (7*a*) is rotatably arranged and which is suitable to be countered against the counter-element (8) by rotation, and a second pivotable end piece (6) is arranged at the second end of the second tubular component (3).

4. A sound post (1) having a variable length, comprising:

a first tubular component (2) having a first end and a second end, a second tubular component (3) having a first end and a second end, wherein the second tubular component (3) is at least partially arranged in the first tubular component (2) in a movable manner, and an elastic member (4) coupled to the first end of the second tubular component (3) is arranged within the first tubular component (2), and wherein a first pivotable end piece (5) is arranged at the first end of the first tubular component (2), and the second end of the first tubular component (2) comprises an outer thread at which a tension fastener element (7*a*) is rotatably arranged, and wherein a counter-element (8) with a second pivotable end piece (6) is arranged at the second end of the second tubular component (3).

5. The sound post (1) according to claim 2, wherein the first tubular component (2) comprises a resting member (7*b*) at its outer side.

6. The sound post (1) according to claim 1, wherein the second tubular component (3) comprises a resting member (7*b*) at its second end.

7. The sound post (1) according to claim 1, wherein an elastic member (4) coupled to the first end of the second tubular component (3) is arranged within the first tubular component (2).

8. The sound post (1) according to claim 1, wherein one or more of the first and the second tubular components (2, 3) and the pivotable end pieces (5, 6) are made of wood.

9. The sound post (1) according to claim 1, wherein one or more of the first and the second tubular components (2, 3) and the pivotable end pieces (5, 6) are made of plastic.

10. The sound post (1) according to claim 1, wherein one or more of the first and the second tubular components (2, 3) and the pivotable end pieces (5, 6) are made of fiber-reinforced plastic.

11. The sound post (1) according to claim 1, wherein the first pivotable end piece (5) and the second pivotable end piece (6) are at least partially coated with a magnetic material.

12. The sound post (1) according to claim 1, wherein the second tubular component (3) comprises a continuous bore (10) arranged transversally to the longitudinal axis of the tubular component (3) between the second end piece (6) and its first end.

13. The sound post (1) according to claim 3, wherein the elastic member (4) is a spring and/or a foamed material and/or consists of two repelling magnets.

14. The sound post (1) according to claim 1, wherein at least one of the tension fastener element (7*a*) and the resting member (7*b*) are of metal or plastic.

15. The sound post (1) according to claim 1, wherein at least one of the tension fastener elements (7*a*) and the resting members (7*b*) has a polygonal cross-section.

16. The sound post (1) according to claim 1, wherein the first tubular component (2) and the second tubular component (3) are substantially cylindrical.

17. The sound post (1) according to claim 1, wherein each end piece (5, 6) comprises a partially spherical section (5*a*, 6*a*) and a flat end surface (5*b*, 6*b*) and the first tubular component (2) at its first end and the second tubular component (3) at its second end each comprise a partially spherical recess in which the respective partially spherical section (5*a*, 6*a*) is received.

18. A sound post tool set for mounting a sound post (1) having a variable length between the top and the back plate of a string instrument, comprising:

a sound post (1) according to claim 1, and at least one adjusting tool (11) comprising a fork-like portion (12), a shaft (13) and a holding portion (14), wherein the shaft (13) is arch-shaped and has a length that corresponds at least to a length of a distance between a predetermined f-hole of the string instrument and a position at a string instrument back plate predetermined for the sound post (1).

19. The sound post tool set according to claim 18, additionally comprising a first magnet and a second magnet suitable to be respectively moved externally along the back and the top plate of the string instrument, respectively, in order to set upright and/or to position the sound post (1).

20. A method for mounting a sound post (1) in or out of a string instrument by means of a sound post adjusting tool, comprising the following steps:

providing a sound post (1) according to claim 3, the sound post (1) being set at a predetermined length selected so that the length of the sound post (1) in a relaxed state is greater than the distance between the back and the top plate of the string instrument and in a compressed state, when a force is exercised against both end pieces (5, 6), is less than the distance between the back and the top plate of the string instrument, providing a sound post adjusting tool (11) comprising a fork-like portion (12), a shaft (13) and a holding portion (14), wherein the shaft (13) is arch-shaped and has a length that corresponds at least to a length of a distance between a predetermined f-hole of the string instrument and a position at a string instrument back plate predetermined for the sound post (1), inserting the sound post (1) in a relaxed state through an f-hole of the string instrument, and fitting the sound post (1) in a position predetermined within the string instrument by wedging the sound post (1) at an angle between the back and the top plate of the string instrument and compressing the elastic member (4) and positioning the sound post (1) vertically between the back and the top plate of the string instrument, inserting the sound post adjusting tool (11) in an f-hole and fixing the length of the sound post (1) by rotating the tension fastener element (7*a*) with the sound post adjusting tool (11) against the counter-element (8).

21. A method for mounting a sound post (1) in or out of a string instrument by means of a sound post adjusting tool, comprising the following steps:

providing a sound post (1) according to claim 1, the sound post (1) being set at a predetermined length selected so that the total length of the first tubular component (2) and the second tubular component (3) of the sound post (1) in the extended state is greater than the distance between the back and the top plate of the string instrument, providing a sound post adjusting tool (11) comprising a fork-like portion (12), a shaft (13) and a holding portion (14), wherein the shaft (13) is arch-shaped and has a length that corresponds at least to a length of a distance between a predetermined f-hole of the string instrument and a position at a string instrument back plate predetermined for the sound post (1), providing a first magnet and a second magnet suitable to be respectively moved externally along the back and the top plate of the string instrument, respectively, in order to set upright and/or to position the sound post (1), inserting the sound post (1) through an f-hole of the string instrument, and setting upright the sound post (1), in a retracted state, and preliminary fitting the sound post (1) in a position predetermined within the string instrument by applying and moving the first magnet externally along the back and the top plate of the string instrument, and rotating the instrument in such a way that the preliminary positioned sound post, in a retracted state, is extended between the back and the top plate of the string instrument due to gravity, and applying the second magnet externally on the back or the top plate of the string instrument opposite the first magnet and to the position of the extended sound post, and finally positioning the extended sound post by moving both the first magnet and the second magnet externally along the back and the top plate of the string instrument, and inserting the sound post adjusting tool (11) in an f-hole and fixing the length of the sound post (1) by rotating the tension fastener element (7*a*) with the sound post adjusting tool (11) against the counter-element (8).

22. The sound post (1) according to claim 10, wherein one or more of the first and the second tubular components (2, 3) and the pivotable end pieces (5, 6) are made of carbon fiber-reinforced plastic.

23. The sound post (1) according to claim 15, wherein at least one of the tension fastener elements (7*a*) and the resting members (7*b*) has an octagonal cross-section.

* * * * *